United States Patent [19]

Haruch

[11] Patent Number: 4,899,937

[45] Date of Patent: Feb. 13, 1990

[54] CONVERTIBLE SPRAY NOZZLE

[75] Inventor: James Haruch, Naperville, Ill.

[73] Assignee: Spraying Systems Co., Wheaton, Ill.

[21] Appl. No.: 191,844

[22] Filed: May 4, 1988

Related U.S. Application Data

[63] Continuation of Ser. No. 940,290, Dec. 11, 1986, abandoned.

[51] Int. Cl.[4] ..... B05B 1/14; B05B 7/00

[52] U.S. Cl. ..... 239/289; 239/396; 239/410; 239/432; 239/575; 239/590.3; 239/590.5; 239/600

[58] Field of Search ..... 239/289, 396, 397, 410, 239/426, 432, 434, 575, 590.3, 590.5, 600

[56] References Cited

U.S. PATENT DOCUMENTS

| | | | |
|---|---|---|---|
| 1,977,782 | 10/1934 | Thomas | 239/600 X |
| 2,633,150 | 3/1953 | Lewis | 239/575 X |
| 2,639,194 | 5/1953 | Wahlin | 239/575 X |
| 2,973,905 | 3/1961 | Ackley | 239/575 |
| 3,208,673 | 9/1965 | Kautz | 239/289 X |
| 4,005,824 | 2/1977 | Becker et al. | 239/289 |
| 4,320,541 | 3/1982 | Neenan | 239/432 X |
| 4,349,156 | 9/1982 | Haruch et al. | 239/432 |
| 4,361,283 | 11/1982 | Heatherington et al. | 239/432 X |
| 4,527,745 | 7/1985 | Butterfield et al. | 239/600 |

*Primary Examiner*—Andres Kashnikow
*Attorney, Agent, or Firm*—Leydig, Voit & Mayer

[57] ABSTRACT

A spray nozzle in which a nozzle body is formed with an elongated chamber having an air inlet port communicating with the side of the chamber, a liquid inlet port communicating with one end of the chamber, and a nozzle tip communicating with the opposite end of the chamber. The spray nozzle may be operated in a hydraulic or non-air assisted mode and with a relatively high flow rate by closing off the air inlet port and causing liquid to stream directly from the liquid inlet port to the nozzle tip. The nozzle also may be converted to an air assisted mode in which a stream of pressurized air is injected into the air inlet port and impinges transversely against the liquid stream to preliminarily break up or preatomize the liquid before the liquid is discharged from the nozzle tip. The conversion is effected by placing into the nozzle body an insert for reducing the flow rate of the liquid stream and for causing the air and liquid streams to interact to effect preatomization of the liquid.

33 Claims, 2 Drawing Sheets

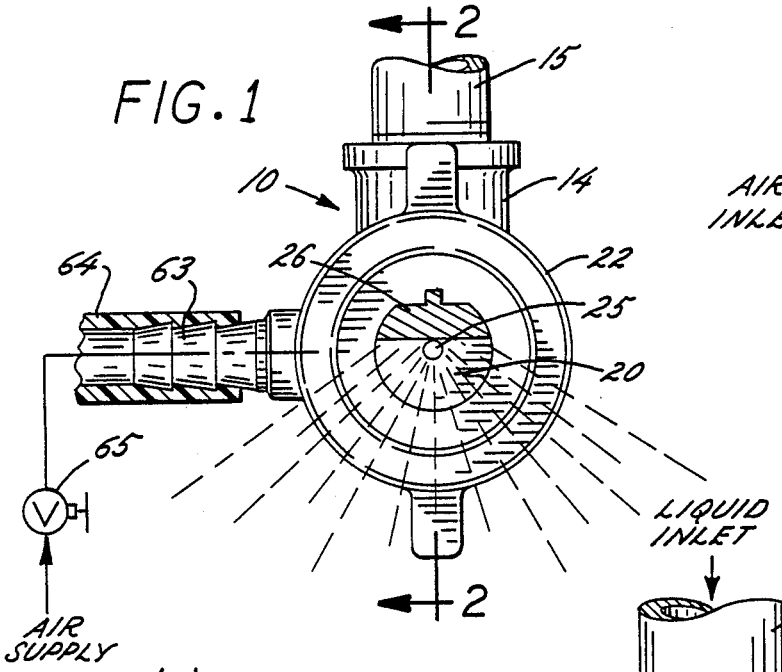
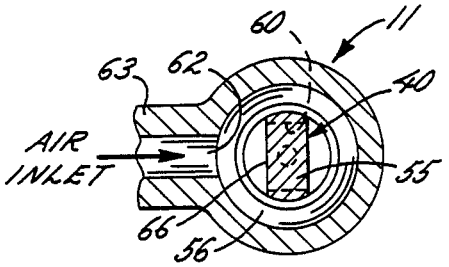
FIG. 4
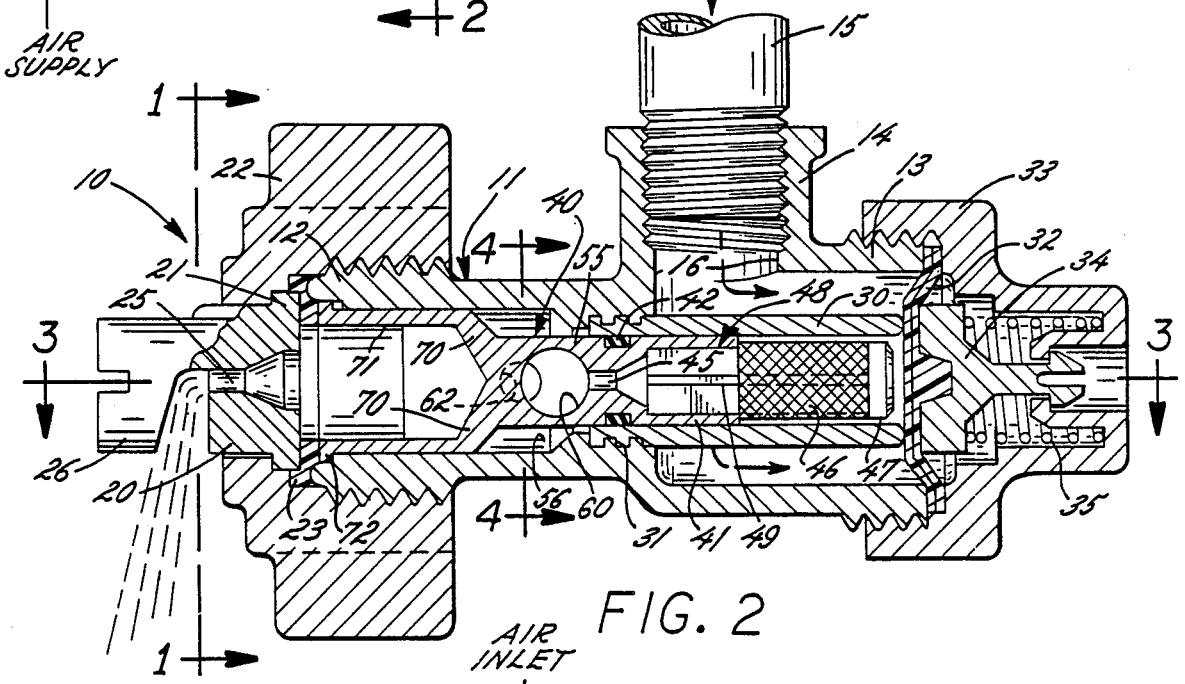
FIG. 2
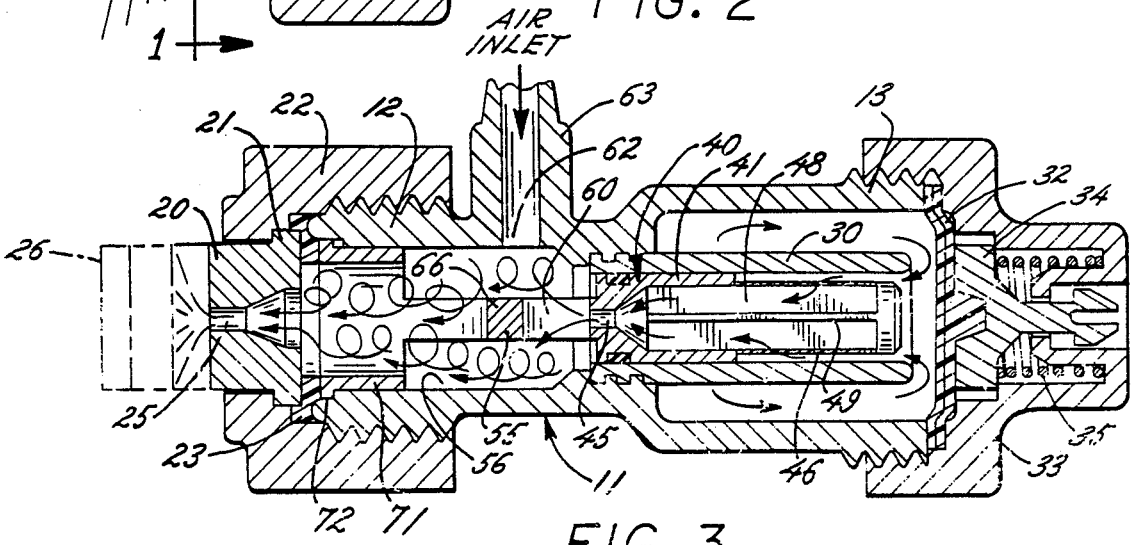
FIG. 3

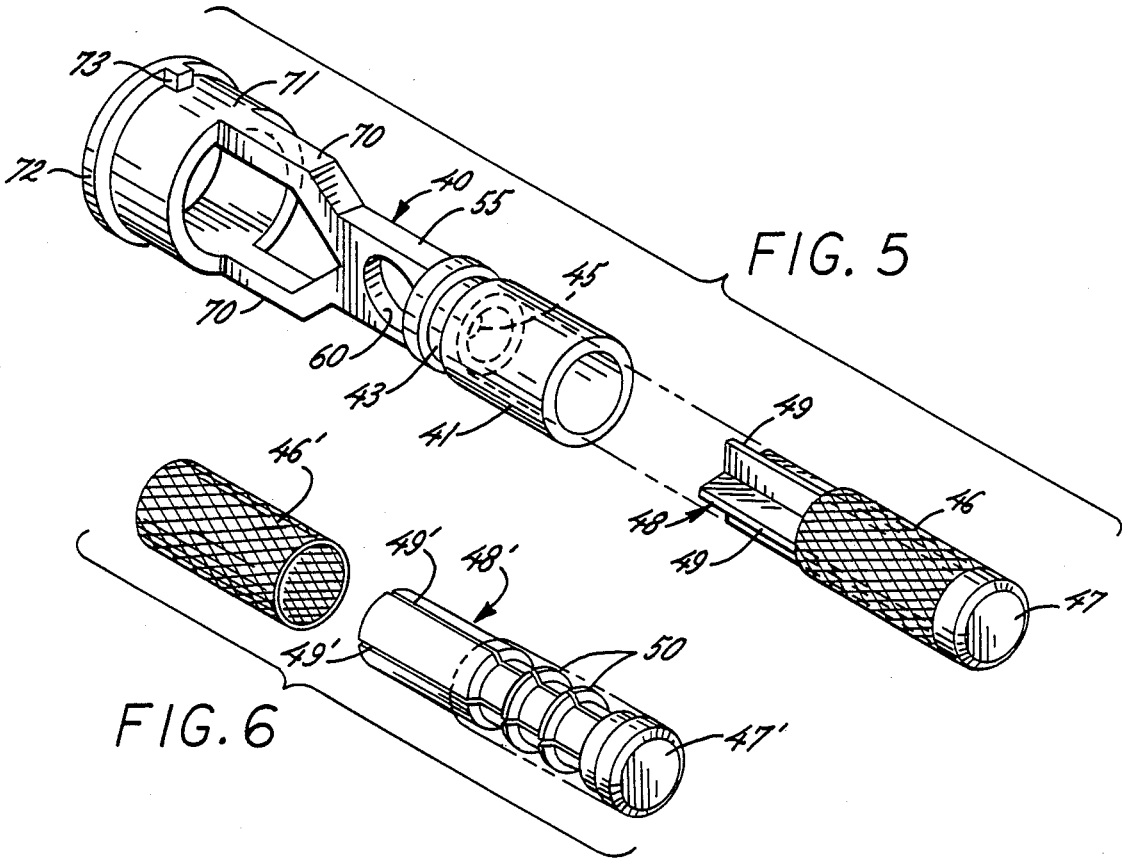
FIG. 5
FIG. 6
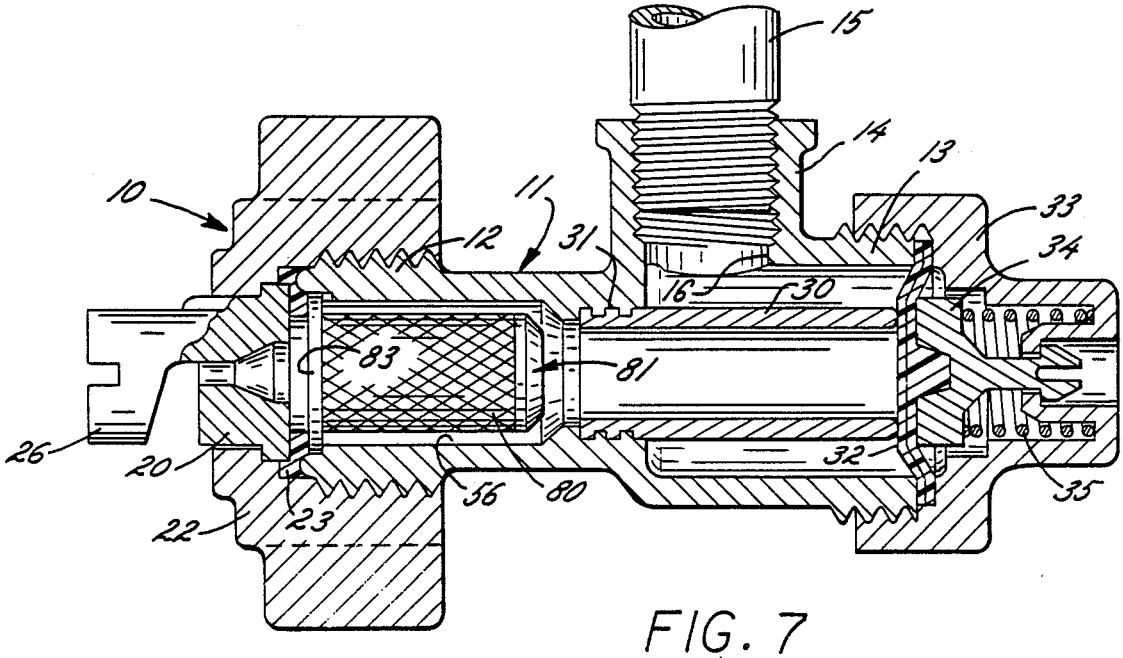
FIG. 7

CONVERTIBLE SPRAY NOZZLE

This application is a continuation of application Ser. No. 940,290, filed Dec. 11, 1986, now abandoned.

BACKGROUND OF THE INVENTION

The present invention relates generally to spray nozzles and, more particularly, to spray nozzles which are adapted for the application of liquids such as agricultural chemicals.

Agricultural chemicals commonly are applied through a multiplicity of spray nozzles which are supported on and spaced along a common support boom. Particularly in recent years, it has been found that such chemicals can be efficiently applied through air assisted nozzles such as that shown in applicant's copending U.S. application Ser. No. 815,117 entitled Air Assisted Nozzle With Deflector Discharge Means, now abandoned. In such a nozzle, a pressurized air stream is injected into the body of the nozzle to preatomize the liquid before it is discharged from the spray tip of the nozzle.

In some instances, however, it is preferred to apply chemicals through non-air assisted nozzles (i.e., conventional hydraulic nozzles) in which the spray pattern is formed as the pressurized liquid is discharged from the nozzle tip. Because of the relatively large number of individual spray nozzles which are mounted on a typical agricultural spray boom, it can be time consuming to replace air assisted nozzles with hydraulic nozzles or vice versa. In addition, one wishing the option of both air assisted application and conventional hydraulic application usually must purchase a supply of both types of nozzles.

SUMMARY OF THE INVENTION

The general aim of the present invention is to provide a new and improved spray nozzle which may be used either as an air assisted nozzle or as a hydraulic nozzle by making a relatively simple and easy conversion to the nozzle.

A more detailed object of the invention is to achieve the foregoing by providing a unique nozzle having internal components which make the nozzle usable as an air assisted nozzle but which may be easily removed from the nozzle body to enable the nozzle to be used as a hydraulic nozzle.

Still another object is to provide a kit comprising a relatively simple and inexpensive nozzle body and comprising internal components adapted to be inserted interchangeably into the body to enable the same body to be used either as part of an air assisted nozzle or as part of a hydraulic nozzle.

The invention also resides in the novel construction of an insert which, when used in the nozzle body, effects turbulent mixing of pressurized air and liquid so as to produce good preatomization of the liquid before the liquid is discharged from the nozzle.

These and other objects and advantages of the invention will become more apparent from the following detailed description when taken in conjunction with the accompanying drawings.

BRIEF DESCRIPTION OF THE DRAWINGS

FIG. 1 is a fragmentary end elevational view, partially in cross-section, of a new and improved spray nozzle incorporating the unique features of the present invention, the view being taken substantially along the line 1—1 of FIG. 2.

FIG. 2 is a fragmentary cross-section taken substantially along the line 2—2 of FIG. 1.

FIG. 3 is a fragmentary cross-section taken substantially along the line 3—3 of FIG. 2 and shows certain parts of the nozzle in moved positions.

FIG. 4 is a fragmentary cross-section taken substantially along the line 4—4 of FIG. 2.

FIG. 5 is an exploded perspective view of certain parts of the nozzle.

FIG. 6 is an exploded perspective view showing a modified version of one of the nozzle parts.

FIG. 7 is a view similar to FIG. 2 but shows the nozzle as having been converted from an air assisted nozzle to a hydraulic nozzle.

While the invention is susceptible of various modifications and alternative constructions, certain preferred embodiments have been shown in the drawings and will be described below in detail. It should be understood, however, that there is no intention to limit the invention to the specific forms described but, on the contrary, the intention is to cover all modifications, alternative constructions and equivalents falling within the spirit and scope of the invention.

DETAILED DESCRIPTION OF THE PREFERRED EMBODIMENTS

For purposes of illustration, the invention is shown in the drawings as embodied in a spray nozzle 10 which is adapted for use in spraying liquid and particularly for spraying liquid fertilizer or insecticide on an agricultural field. When used for agricultural purposes, several nozzles are secured to and are spaced along an elongated hollow boom (not shown) which also serves as a manifold for delivering liquid under high pressure to the nozzles. Reference is made to Butterfield et al U.S. Pat. No. 4,527,745 for an explanation as to how a nozzle of the same general type as the present nozzle may be secured to a boom or pipe and receive pressurized liquid therefrom.

The nozzle 10 includes an elongated hollow body 11 molded of plastic and having opposite end hubs 12 and 13 which are externally threaded. An internally threaded hub 14 is formed integrally with and projects from one side of the body and receives a threaded pipe 15 which communicates with the boom to receive pressurized liquid therefrom. The lower end of the hub 14 defines a circular inlet port 16 (FIG. 2) through which liquid is introduced into the nozzle body 11.

As shown most clearly in FIG. 2, a discharge nozzle tip 20 is located adjacent the end of the hub 12 of the body 11. To mount the tip, the latter is formed with a radially extending peripheral flange 21 which is clamped to the end of the hub 12 by a clamping nut or cap 22 adapted to be threaded onto the hub. An annular gasket 23 is interposed between the tip 21, the cap 22 and the end of the hub 12 in order to seal the perimeter of the tip.

An axially extending discharge orifice 25 is formed through the nozzle tip 20. Formed integrally with the nozzle tip is a deflector flange 26 (FIG. 2) which is disposed transversely to the line of travel of the liquid flowing through the discharge orifice 25. Such liquid forcefully strikes the deflector flange 26 and is broken down and atomized into particles of relatively small size. In addition, the deflector flange directs the particles into a well-defined flat fan spray pattern transverse to the axis of the nozzle body 11. The construction, operation and advantages of the nozzle tip 20 and the discharge flange 26 are disclosed in greater detail in my aforementioned U.S. application Ser. No. 815,117.

Liquid which is admitted into the nozzle body 11 via the inlet port 16 is shaped into a longitudinally flowing stream by a cylindrical tube 30 (FIG. 2). The tube is coaxial with and is spaced inwardly from the wall of the body and its downstream end is threadably connected to the body at 31. As disclosed in commonly assigned Butterfield et al U.S. application Ser. No. 818,210, now U.S. Pat. No. 4,660,598, the tube coacts with a resiliently flexible diaphragm 32 to form an antidrip valve which prevents liquid from dripping from the nozzle tip 20 after the supply of pressurized liquid to the inlet pipe 15 has been cut off. For this purpose, the diaphragm is located adjacent the upstream end of the tube 30 and its peripheral margin is clamped between the end of the hub 13 and a cap 33 which is threaded onto the hub. A valve follower 34 is supported slidably within the cap and is operably connected to the diaphragm. Telescoped into the cap is a coiled compression spring 35 which urges the diaphragm toward a closed position against the upstream end of the tube 30 as shown in FIG. 2. When liquid under pressure is delivered to the nozzle body 11 via the inlet pipe 15, the pressurized liquid urges the diaphragm 32 away from the upstream end of the tube as shown in FIG. 3 so as to enable the liquid to flow through the tube and to be sprayed from the nozzle tip 20. Upon cutting off of the liquid at the pressure source, the spring 35 forces the diaphragm 32 into sealing engagement with the upstream end of the tube 30 so as to substantially prevent liquid from dripping out of the nozzle tip.

As described thus far, the nozzle 10 is basically suitable for use as a hydraulic or non-air assisted nozzle in the same general manner as the nozzle disclosed in the aforementioned Butterfield et al application. In a pure hydraulic nozzle (i.e., a non-air assisted nozzle), the pressurized liquid is delivered through the nozzle at a relatively high flow rate and is broken up into relatively large particles upon being sprayed from the nozzle tip 20. Hydraulic nozzles are generally preferred for use under conditions where it is desired to spray a field with relatively large quantities of a liquid chemical solution having a high percentage of water.

For other agricultural applications, air assisted nozzles are preferred over pure hydraulic nozzles. In general terms, an air assisted nozzle is a nozzle in which the liquid flows through the nozzle at a comparatively slow flow rate and in which a pressurized stream of air is injected into the nozzle in order to preliminarily break up or atomize the liquid prior to the liquid being sprayed from the nozzle tip. Air assisted nozzles are generally used in situations where a comparatively small quantity of a more highly concentrated chemical solution is to be sprayed on a field of given area.

In accordance with the present invention, the nozzle 10 is provided with a unique insert member 40 (FIGS. 2 and 5) which may be placed in the nozzle to enable the nozzle to operate in an air assisted mode and which may be removed easily from the nozzle to convert the nozzle for use in a hydraulic mode. As will become apparent, the insert 40 permits the nozzle 10 to be easily changed over from air assisted to hydraulic, or vice versa, without need of maintaining a supply of each type of nozzle and without need of removing one type of nozzle from the boom and installing the other type of nozzle on the boom each time a conversion is made.

More specifically, the insert 40 includes a tubular orifice member 41 (FIGS. 2 and 5) made of brass or the like. The orifice member is cylindrical and is telescoped into the downstream end of the tube 30 with a tight but sliding fit. An O-ring 42 (FIG. 2) fits within a groove 43 (FIG. 5) around the outer periphery of the orifice member 41 and is compressed against the inner wall of the tube 30 to establish a seal between the orifice member and the tube.

Formed through the downstream end portion of the orifice member 41 is a flow restricting orifice 45 which serves to reduce the flow rate of liquid flowing from the tube 30 toward the nozzle tip 20. In this particular instance, the orifice includes a frustoconical upstream portion whose small diameter end joins a cylindrical downstream portion.

Dirt and other foreign particles are filtered from the liquid before the liquid flows through the orifice 45. For this purpose, a tubular screen-like strainer 46 extends from the upstream end of the orifice member 41 and is spaced radially inwardly from the wall of the tube 30 so that liquid entering the tube must pass radially through the strainer before flowing to the orifice 45. One end of the strainer 46 abuts the upstream end of the orifice member 41 while the other end of the strainer abuts and is closed off by the head 47 (FIG. 5) of a pin 48. The latter is telescoped slidably into both the strainer and the upstream end of the orifice member. In the embodiment shown in FIGS. 1 to 5, the pin is of cruciform cross-section and is formed with four angularly spaced fins 49 (FIG. 5) which define flow passages permitting liquid to flow through the strainer and into the orifice member. When the insert 40 is removed from the nozzle body 11, the pin 48 may be pulled out of the orifice member 41 and then the strainer 46 may be pulled off of the pin to permit cleaning or replacement of the strainer.

A modified pin 48 for supporting the strainer 46 is shown in FIG. 6. In this instance, the pin is hollow and generally cylindrical and is formed with four angularly spaced and longitudinally extending slots 49' which permit liquid to flow into the pin and then to the orifice member 41. Two axially spaced rings 50 extend circumferentially around the pin 48 and hold the strainer in radially outwardly spaced relation with the body of the pin.

In carrying out the invention, the insert 40 includes an elongated impingement element 55 (FIG. 5) for breaking up the stream of liquid flowing through the orifice 45 and for causing the liquid to mix with a pressurized air stream which also is broken up by the impingement element. Herein, the impingement element 55 is in the form of an elongated and flat bar formed integrally with the downstream end of the orifice member 41, the bar being of rectangular cross-section. The bar 55 extends longitudinally into an axially elongated mixing chamber 56 of circular cross-section defined within the nozzle body 11. As shown in FIGS. 2 and 3, the rectangular bar 55 is spaced inwardly from the circular wall of the chamber around the entire periphery of the bar.

A transversely extending circular hole 60 is formed through the bar 55 immediately downstream of the orifice 45. The hole 60 communicates with the orifice 45 and, as pressurized liquid is discharged from the orifice, it strikes the downstream wall of the hole. The downstream wall thus defines an impingement surface which deflects the liquid transversely to break up the liquid and cause the liquid to flow through the chamber 56 along the sides of the bar 55.

As the liquid flows through the chamber 56, it is preliminarily broken up by a pressurized stream of air which is admitted into the chamber 56 through a circular air inlet port 62 (FIG. 3) formed in the nozzle body 11 and extending transversely to the chamber and the stream of liquid flowing through the chamber. The inlet port 62 is located at the inner end of a fitting 63 (FIGS. 1 and 3) joined to the nozzle body 11 and connected to a flexible tube 64 which communicates with a supply of pressurized air by way of a shut off valve 65. When the valve is opened, a stream of pressurized air is injected transversely into the chamber 56.

As shown in FIGS. 2 and 3, the axis of the air inlet port 62 extends parallel to the axis of the hole 60 in the bar 55 but the port 62 is smaller in diameter than the hole 60 and its axis is offset in a downstream direction from the axis of the hole. As a result, only about one-half of the area of the air inlet port 62 is in registry with the hole 60 while the downstream half of the air inlet port is located in opposing relation with a side surface area 66 (FIG. 4) of the bar 55. By virtue of this arrangement, the surface 66 defines an impingement surface which deflects and breaks up the air stream. Considerable turbulence for preatomizing the liquid stream is created by the air stream being broken up by the impingement surface 66, by the liquid stream being broken up by the wall of the hole 60 and as a result of the air stream being injected transversely into the longitudinally flowing liquid stream. The liquid thus flows toward the nozzle tip 20 in the form of finely divided particles.

The insert 40 is completed by two radially spaced webs 70 (FIG. 5) formed integrally with and extending axially from the bar 55 and having downstream ends joined to a cylindrical sleeve 71. Formed on the downstream end of the sleeve is an outwardly radially extending flange 72 which is adapted to be clamped by the cap 22 between the sealing gasket 23 and an internal shoulder at the downstream end portion of the nozzle body 11. An axially extending key 73 (FIG. 5) at the upstream side of the flange 72 fits into a keyway in the nozzle body 11 so as to orient the insert 40 angularly in the body in such a manner that the axis of the hole 60 extends parallel to the axis of the air inlet port 62.

When the insert 40 is in place in the nozzle body 11, the flow rate of the liquid stream is reduced by the orifice 45 and, in addition, the stream is preliminarily atomized by the coaction of the wall of the hole 60, the impingement surface 66 of the bar 55 and the mutually transverse flow relation between the liquid stream and the air stream. The insert 40 may be removed from the body 11 simply by unscrewing the cap 22 and taking the cap, the nozzle tip 20 and the sealing gasket 23 off of the body as a unit. Thereafter, the insert with the attached pin 48 and strainer 46 may be pulled axially out of the downstream end of the body 11.

When the insert 40 is out of the body 11, the nozzle 10 may be converted for use in a hydraulic mode simply by placing a tubular strainer 80 in the chamber 56 as shown in FIG. 7. The strainer 80 is telescoped over a pin 81 which may be similar to the pins 48 or 48' and which is formed with a radially extending flange 83 at its downstream end. The flange 83 is adapted to be clamped against the internal shoulder in the body 11 by the gasket 23 when the cap 22 and the nozzle tip 20 are screwed back on to the body. To facilitate even faster assembly and disassembly of the cap 22, the latter may be of the quick disconnect bayonet type such as disclosed in Butterfield et al U.S. Pat. No. 4,527,745. The strainer 80 also may be similar to the strainer disclosed in such patent.

When the nozzle 10 is set up as shown in FIG. 7 for use in the hydraulic mode, the air fitting 63 is closed off to prevent liquid from escaping through the fitting. This may be accomplished either by shutting off the valve 65, by pinching the tube 64 closed with a clamp or by disconnecting the tube from the fitting 63 and inserting plug into the fitting.

From the foregoing, it will be apparent that the present invention brings to the art a new and improved nozzle 10 which may be quickly and easily converted between an air assisted, relatively low flow rate mode and a non-air assisted, comparatively high flow rate mode. When set up in the air assisted mode, the nozzle effects very good preliminary atomization of the liquid as a result of the interaction of the insert 40 with the air and liquid streams.

I claim:

1. A liquid spray nozzle which may be converted from an air assisted nozzle to a non-air assisted nozzle, said spray nozzle comprising an elongated hollow nozzle body having first and second ends, a chamber defined in said body, means in said body defining an air inlet port through which a pressurized stream of air may be injected transversely into said chamber, selectively actuatable means for directing pressurized air through said air inlet port, means in said body defining a liquid inlet port for introducing liquid into said body, means for directing pressurized liquid through said liquid inlet port, means defining a tube disposed within and extending longitudinally of said body for receiving liquid from said liquid inlet port and for directing a longitudinally flowing stream of liquid into said chamber, an insert member removably positioned in said tube, said insert member being formed with an internal liquid flow passageway through which liquid received in said tube passes and an impingement surface located in fixed relation to said liquid passageway in line with the direction of passage of said liquid through said insert member liquid passageway, means securing said insert member in said body with said impingement surface in fixed relation to said liquid inlet port so that a liquid flow stream introduced into said body from said inlet port continuously strikes said impingement surface without relative movement between said impingement surface and said liquid inlet port and passageway and is continuously deflected and mixed with a pressurized stream of air introduced into said chamber from said air inlet port upon actuation of said pressurized air direction means whereby the liquid is preliminarily atomized in said chamber, spray tip means defining a discharge orifice in fluid communication with said chamber and through which liquid from said chamber is directed, and means on one of said ends of said body and removable therefrom to permit said insert member to be taken axially out of said body so that upon deactuation of said pressurized air directing means a stream of liquid introduced into said body from said liquid inlet port flows through said chamber without engaging an impingement surface and without significant preliminary atomization and is dispensed directly by said spray tip into predetermined spray pattern of liquid droplets.

2. The liquid spray nozzle of claim 1 in which said insert member flow passageway defines an orifice for restricting the flow of said stream of liquid prior to striking said impingement surface.

3. An air assisted liquid spray nozzle comprising an elongated hollow nozzle body having first and second ends, a chamber extending longitudinally in said body, means in said body defining an air inlet port through which a pressurized stream of air may be directed transversely into said chamber, means in said body defining a liquid inlet port for introducing liquid into said body, a tube disposed within and extending longitudinally of said body for receiving liquid from said liquid inlet port and for directing a longitudinally flowing stream of liquid, an insert member coupled to said tube, said insert member being formed with an internal liquid flow passageway through which liquid received in said tube passes and an impingement surface located in fixed relation to said liquid passageway in line with the direction of passage of said liquid through said insert member liquid passageway, means securing said insert member in said body with said impingement surface in fixed relation to said liquid inlet port so that a liquid flow stream introduced into said body from said inlet port continuously strikes said impingement surface and said liquid inlet port and passageway and is continuously deflected and mixed with a pressurized stream of air introduced into said body chamber from said air inlet port whereby the liquid is preliminary atomized in said chamber, and spray tip means defining a discharge orifice in fluid communication with said chamber and through which liquid from said chamber is discharged in a predetermined liquid spray pattern.

4. The air assisted liquid spray nozzle of claim 3 in which said insert member flow passageway defines an orifice or restricting the flow of said stream of liquid prior to striking said impingement surface.

5. The combination of, a liquid spray nozzle, and a kit for converting said nozzle from a non-air assisted operation to an air assisted operation;

said nozzle comprising an elongated hollow nozzle body having a discharge end and an opposite non-discharge end, a chamber defined in said body, means in said body defining a liquid inlet port for introducing liquid into said body, a tube disposed within and extending longitudinally of said body for receiving liquid from said liquid inlet port and for directing a longitudinally flowing stream of liquid longitudinally into said chamber, means in said body defining an air inlet port located downstream of said tube and through which a pressurized stream of air may be injected transversely into said chamber, spray tip means defining a discharge orifice adjacent the discharge end of said body in fluid communication with said chamber and through which liquid from said chamber is sprayed from said body, and a cap supporting said spray tip means and removably connected to the discharge end of said body;

said kit comprising a strainer for use with said spray nozzle to enable non-air assisted operation of said nozzle, said strainer being tubular and being positionable in said chamber, a radially extending flange on the downstream end of said strainer and adapted to be clamped between said cap and the downstream end of said body to hold said strainer in said chamber when said nozzle is set up for non-air assisted operation, said strainer being removable endwise from the discharge end of said body when said cap and said spray tip means are removed from said body;

said kit further comprising an insert for use with said spray nozzle in place of said strainer to alternately enable air assisted operation of said nozzle, said insert comprising an elongated member positionable within said tube and said chamber, a tubular strainer supported on one end position of said elongated member, said elongated member being formed with an internal liquid flow passageway through which liquid introduced received in said tube passes and an impingement surface located in fixed relation in said liquid passageway in line with the direction of passage of said liquid through said insert member liquid passageway, means securing said insert member in said body with said impingement surface in fixed relation to said liquid inlet port so that a liquid flow stream introduced into said body from said inlet port continuously strikes said impingement surface without relative movement between said impingement surface and said liquid inlet port and passageway and is continuously deflected and mixed with a pressurized stream of air introduced into said body chamber from said air inlet port whereby the liquid is preliminary atomized in said chamber, and said insert having a radially extending flange on the downstream end of said elongated member and adapted to be clamped between said end cap and the downstream end of said body so as too hold said elongated member in said chamber and said tube when said nozzle is set up for air assisted operation, said elongated member and the strainer supported thereby being removable endwise from the discharge end of said body when said cap and said spray tip means are removed from said body.

6. The liquid spray nozzle of claim 5 in which said insert member flow passageway defines an orifice for restricting the flow of said stream of liquid prior to striking said impingement surface.

7. A spray nozzle which may be converted from an air assisted nozzle to a non-air assisted nozzle, said spray nozzle comprising an elongated hollow nozzle body having first and second ends, an elongated chamber defined in said body, means in said body defining an air inlet port through which a pressurized stream of air may be transversely injected into said chamber, means in said body defining a liquid inlet port for introducing liquid into said body, means in said body for causing said liquid to flow longitudinally through said chamber in a stream which mixes with the pressurized stream of air injected into said chamber through said air inlet port whereby said liquid is preliminarily atomized in said chamber, an orifice member removably mounted in said body and defining an orifice for restricting the flow rate of said stream of liquid after such stream enters said liquid inlet port and before such stream is preliminarily atomized in said chamber by said air stream, said orifice member having an integrally formed bar that extends longitudinally of said chamber and is spaced transversely inwardly from the walls thereof for deflecting air and liquid stream to promote mixing thereof and preliminary atomization of said liquid, said bar being formed with a transversely directed hole therethrough immediately downstream of and in fluid communication with the orifice in said orifice member whereby liquid discharging from said orifice strikes a downstream wall of said hole and is deflected transversely for flow along the sides of said bar, means defining a discharge orifice located adjacent said first end of said body and in fluid communication with said chamber, said discharge orifice receiving preliminarily atomized liquid from said chamber and causing such liquid to spray out of said nozzle, and means on said body and selectively removable therefrom to permit said orifice member to be taken out of said body so as to enable said stream of liquid to flow through said chamber without the flow rate of the liquid stream being restricted before such stream reaches said discharge orifice.

8. A spray nozzle as defined in claim 7 in which the axis of said hole extends parallel to and is spaced upstream of the axis of said air inlet port, said air inlet port being only in partial registry with said hole whereby a portion of the air stream injected through said air inlet port impinges against said bar while another portion of said air stream passes through said hole.

9. A spray nozzle comprising an elongated hollow nozzle body having first and second ends, a chamber defined in said body, means in said body defining an air inlet portion through which a pressurized stream of air may be injected transversely into said chamber, means in said body defining a liquid inlet port for introducing liquid into said body, a tube disposed within and extending longitudinally of said body for receiving liquid from said liquid inlet port and for directing a longitudinally flowing stream of liquid into said chamber, an orifice member in said tube and defining an orifice for restricting the flow rate of said longitudinally flowing stream of liquid before the latter enters said chamber, said orifice member having an integrally formed impingement element in the form of a bar extending longitudinally of said chamber and spaced inwardly from the walls thereof, said bar being formed with a transversely directed hole therethrough immediately downstream of and in fluid communication with the orifice in said orifice member whereby liquid discharged through said orifice strikes a downstream wall of said hole and is deflected transversely for flow along the sides of said bar, said orifice member impingement element having surface means for deflecting the pressurized stream of air flowing transversely into said chamber from said air inlet port for causing preliminary atomization of liquid deflected by said bar, and means defining a discharge orifice in fluid communication with said chamber and through which liquid from said chamber is directed.

10. A liquid spray nozzle which may be converted from an air assisted nozzle to a non-air assisted nozzle, said spray nozzle comprising a hollow nozzle body which defines a chamber, means in said body defining an air inlet port through which a pressurized stream of air may be injected into said chamber, selectively actuatable means for directing pressurzied air through said air inlet port, means in said body defining a liquid inlet port for introducing a liquid flow stream into said body, means for directing pressurized liquid through said liquid inlet port, an insert member removably mountable into said body, said insert member being formed with an internal liquid flow passageway through which liquid introduced into said body passes and an impingement surface located in fixed relation with said liquid passageway in line with the direction of passage of said liquid through said liquid passageway, means securing said insert member in said body with said impingement surface in fixed relation to said liquid inlet port so that a liquid flow stream introduced into said body from said inlet port continuously strikes said impingement surface without relative movement between said impingement surface and said liquid inlet port and passageway and is continuously deflected and mixed with a pressurized stream of air introduced into said body chamber from said air inlet port upon actuation of said pressurized air direction means whereby the liquid is preliminary atomized in said chamber, a spray tip which defines a discharge orifice adjacent in fluid communication with said chamber for receiving preliminary atomized liquid from said chamber and causing said liquid to spray out of said nozzle in a predetermined pattern of liquid droplets, and means on said body and selectively removable therefrom for permitting said insert member to be removed from said body so that upon deactuation of said pressurized air directing means a stream of liquid introduced into said body from said liquid inlet port flows through said chamber without engaging an impingement surface and without significant preliminary atomization and is dispensed directly by said spray tip into predetermined spray pattern of liquid droplets.

11. The liquid spray nozzle of claim 10 in which said insert member is tubular, a pin telescoped into the upstream end portion of said orifice member, a tubular strainer telescoped over said pin, said pin including means permitting liquid to flow through said strainer and into said orifice member.

12. The liquid spray nozzle of claim 10 further including a sleeve on the downstream end of said insert member and in fluid communication with said chamber, a radially extending flange on the downstream end of said sleeve, said selectively removable means comprising a cap on said first end of said body and operable to clamp said flange against said first end of said body.

13. A spray nozzle as defined in claim 12 in which said discharge orifice is supported by said cap.

14. The liquid spray nozzle of claim 10 in which said insert member flow passageway defines an orifice for restricting the flow of said stream of liquid prior to striking said impingement surface.

15. The liquid spray nozzle of claim 10 including means permitting communication of pressurized air from said air inlet port to said impingement surface.

16. The liquid spray nozzle of claim 15 in which said air inlet port directs a pressurized air stream into said chamber in a direction transverse to the direction of liquid passing through said insert member passageway.

17. The liquid spray nozzle of claim 16 in which said air inlet port directs pressurized air into said chamber so that at least a portion thereof passes across said impingement surface.

18. The liquid spray nozzle of claim 17 in which said insert member impingement surface is oriented so that it is in substantially perpendicular relation to the direction of liquid flow through said insert member flow passageway.

19. The liquid spray nozzle of claim 10 in which said chamber has an elongated configuration, and said insert member has an elongated configuration and is mountable in said body in coaxial relation to said elongated chamber.

20. The liquid spray nozzle of claim 19 in which said flow passageway extends longitudinally into said insert member from one end thereof, and said impingement surface is integrally formed said insert member.

21. The liquid spray nozzle of claim 19 in which a tube is disposed within said chamber, said tube having an inlet end for receiving liquid introduced into said body from said liquid inlet port and an outlet end for communicating liquid to said insert member flow passageway.

22. The liquid spray nozzle of claim 21 in which said liquid inlet port extends into a side of said body at a longitudinal location intermediate the ends of said tube, and said air inlet port communicates with said chamber through a side of said body at a location between said liquid inlet port and said spray tip.

23. The liquid spray nozzle of claim 22 in which said air inlet port communicates with said chamber at a location intermediate the ends of said insert member.

24. An air assisted liquid spray nozzle comprising of hollow nozzle body which defines a chamber, means in said body defining an air inlet port through which a pressurized stream of air may be directed into said chamber, means for directing pressurized air through said air inlet port, means in said body defining a liquid inlet port for introducing a liquid flow stream into said body, means for directing pressurized liquid through said liquid inlet port, an insert member removably mountable into said body, said insert member being formed with an internal liquid flow passageway through which liquid introduced into said body passes and an impingement surface located in fixed relation to said liquid passageway in line with the direction of passage of said liquid through said liquid passageway, means securing said insert member in said body with said impingement surface in fixed relation to said liquid inlet port so that a liquid flow stream introduced into said body from said inlet port continuously strikes said impingement surface without relative movement between said impingement surface and said liquid inlet port and passageway and is continuously deflected and mixed with a pressurized stream of air introduced into said body chamber from said air inlet port upon actuation of said pressurized air directing means whereby the liquid is preliminary atomized in said chamber, and a spray tip defining a discharge orifice in fluid communication with said chamber for receiving preliminary atomized liquid from said chamber and causing said liquid to spray out of said nozzle in a predetermined pattern of liquid droplets.

25. The liquid spray nozzle of claim 24 in which said insert member flow passageway defines an orifice for restricting the flow of said stream of liquid prior to striking said impingement surface.

26. The liquid spray nozzle of claim 24 including means permitting communication of pressurized air from said air inlet port to said impingement surface.

27. The liquid spray nozzle of claim 26 in which said air inlet port directs a pressurized air stream into said chamber in a direction transverse to the direction of liquid passing through said insert member passageway.

28. The liquid spray nozzle of claim 27 in which said air inlet port directs pressurize air into said chamber so that at least a portion thereof passes across said impingement surface.

29. The liquid spray nozzle of claim 28 in which said insert member impingement surface is oriented so that it is in substantially perpendicular relation to the direction of liquid flow through said insert member flow passageway.

30. The liquid spray nozzle of claim 29 in which said impingement surface is integrally formed said insert member.

31. A liquid spray nozzle which may be converted from an air assisted nozzle to a non-air assisted nozzle, said spray nozzle comprising a hollow nozzle body which defines an elongated chamber, means in said body defining an air inlet port through which a pressurized stream of air may be injected into said chamber, selectively actuatable means for directing pressurized air through said air inlet port, means in said body defining a liquid inlet port for introducing a liquid flow stream into said body, means for directing pressurized liquid through said liquid inlet port, an elongated insert member removably mountable into said body in coaxial relation to said elongated chamber, said insert member being formed with an internal longitudinally oriented liquid flow passageway through which liquid introduced into said body passes and an integrally formed impingement surface in line with the direction of passage of said liquid through said liquid passageway and against which said liquid strikes for detecting said liquid and mixing it with a pressurized stream of air introduced into said body chamber from said air inlet port upon actuation of said pressurized air direction means, said impingement surface being defined by an aperture extending through said insert member transversely to the longitudinal axis of said insert member, said air inlet port communicating with insert member aperture in a manner that causes pressurized air directed into said chamber from said air inlet port to pass across an impingement surface whereby the liquid striking said impingement surface is preliminarily atomized in said chamber, a spray tip which defines a discharge orifice in fluid communication with said chamber for receiving preliminarily atomized liquid from said chamber and causing said liquid to spray out of said nozzle in a predetermined pattern of liquid droplets, and means on said body and selectively removable therefrom for permitting said insert member to be removed from said body so that upon deactuation of said pressurized air directing means a stream of liquid introduced into said body from said liquid inlet port flows through said chamber without engaging an impingement surface and without significant preliminary atomization and is dispensed directly by said spray tip into predetermined spray pattern of liquid droplets.

32. An air assisted liquid spray nozzle comprising a hollow nozzle body which defines a chamber, means in said body defining an air inlet port through which a pressurized stream of air may be directed into said chamber, selectively actuatable means for directing pressurized air through said air inlet port, means in said body defining a liquid inlet port for introducing a liquid flow stream into said body, means for directing pressurized liquid through said liquid inlet port, an insert member removably mountable into said body, said insert member being formed with an internal liquid flow passageway through which liquid introduced into said body passes and an integrally formed impingement surface in substantially perpendicular relation to the direction of passage of said liquid through said liquid passageway and against which said liquid strikes for deflecting said liquid and mixing it with a pressurized stream of air introduced into said body chamber from said air inlet port upon actuation of said pressurized air directing means, said impingement surface being defined by an aperture extending through said insert member transversely to the longitudinal axis of said insert member, said air inlet port communication with insert member aperture in a manner that causes at least a portion of the pressurized air directed into said chamber for said air inlet port to pass across said impingement surface in a direction transverse to the direction of liquid passing through said insert member passageway whereby the liquid striking said impingement surface is preliminarily atomized in said chamber, and a spray tip which defines a discharge orifice in fluid communication with said chamber for receiving preliminarily atomized liquid from said chamber and causing said liquid to spray out of said nozzle in a predetermined pattern of liquid droplets.

33. An air assisted liquid spray nozzle comprising a hollow nozzle body which defines a chamber, means in said body defining an air inlet port through which a pressurized stream of air may be directed into said chamber, means for directing pressurized air through said air inlet port, means in said body defining a liquid inlet port for introducing a liquid flow stream into said body, means for directing pressurized liquid through said liquid inlet port, an insert member removably mountable into said body, said insert member being formed with an internal liquid flow passageway through which liquid introduced into said body passes and an impingement surface in line with the direction of passage of said liquid through said liquid passageway against which said liquid strikes for deflecting said liquid and mixing it with a pressurized stream of air introduced into said body chamber from said air inlet port upon actuation of said pressurized air directing means whereby the liquid is preliminarily atomized in said chamber, said impingement surface being defined by an aperture that extends into said insert member and is in communication both with said liquid passageway and said air inlet port, and a spray tip which is defining a discharge orifice in fluid communication with said chamber for receiving preliminarily atomized liquid from said chamber and causing said liquid to spray out of said nozzle in a predetermined pattern of liquid droplets.

* * * * *

UNITED STATES PATENT AND TRADEMARK OFFICE

CERTIFICATE OF CORRECTION

PATENT NO. : 4,899,937

DATED : February 13, 1990

INVENTOR(S) : James Haruch

It is certified that error appears in the above-identified patent and that said Letters Patent is hereby corrected as shown below:

Col. 12, line 17, "detecting" should be -- deflecting --.

Col. 12, line 65, "communication" should be -- communicating --.

Col. 12, line 67, "for" should be -- from --.

Signed and Sealed this

Fourteenth Day of May, 1991

*Attest:*

HARRY F. MANBECK, JR.

*Attesting Officer*

*Commissioner of Patents and Trademarks*